United States Patent [19]

Walls

[11] Patent Number: 5,013,270

[45] Date of Patent: May 7, 1991

[54] RIVER RAFT

[76] Inventor: H. Wayne Walls, P.O. Box 222, Pagosa Springs, Colo. 81147

[21] Appl. No.: 421,808

[22] Filed: Oct. 16, 1989

[51] Int. Cl.[5] ..... B63C 13/00

[52] U.S. Cl. ..... 441/45; 114/61

[58] Field of Search ..... 114/61, 201 R, 267, 114/357, 363, 343; 440/104, 105; 441/44, 45, 65, 74

[56] References Cited

U.S. PATENT DOCUMENTS

| | | | |
|---|---|---|---|
| 2,975,747 | 3/1961 | Opie | 114/61 |
| 3,758,897 | 9/1973 | Shaw | 441/45 |
| 3,785,317 | 1/1974 | Currey | 441/45 |
| 3,796,175 | 3/1974 | Ford et al. | 114/61 |

FOREIGN PATENT DOCUMENTS

| | | |
|---|---|---|
| 195703 | 9/1986 | European Pat. Off. . |
| 2140277 | 1/1973 | France . |
| 2354133 | 6/1978 | France . |
| 2608460 | 6/1988 | France . |

*Primary Examiner*—Sherman D. Basinger
*Assistant Examiner*—Stephen P. Avila
*Attorney, Agent, or Firm*—Harrison & Egbert

[57] ABSTRACT

A raft comprising a first pontoon, a second pontoon, a framework detachably connected to the first and second pontoons and positioned on the top surface of the first and second pontoons, and a floor connected to the framework so as to define a surface extending on the framework above the first and second pontoons. Each of the pontoons has an upwardly tilted pointed forward and rearward end. The framework comprises a plurality of segmented and connected longitudinal members and crossmembers extending across the pontoon. Each of the longitudinal members and crossmembers is made of a plurality of detachable sections. The floor includes a mesh netting saddle surfaces, and solid decking.

18 Claims, 5 Drawing Sheets

RIVER RAFT

TECHNICAL FIELD

The present invention relates to vehicles for travel on water. More particularly, the present invention relates to catamarans and river rafts. More specifically, the present invention relates to rafts having pontoons and collapsible frames.

BACKGROUND ART

In 1954, George E. White and Harry Aleson lacked a boat, but not the determination, for running the Colorado River through the Grand Canyon. They decided to not let a small problem like that stop them, and so they strapped on their life jackets and floated the lower canyons without a boat. Two years later, they were able to buy a military surplus raft and run the river that way.

Floating a river with only a life jacket is certainly one way to get an intimate feel of the river's currents, but it's difficult to carry gear and the idea doesn't appeal to everyone. Fortunately, big black neoprene rafts of the U.S. Navy became available as surplus after World War II. These rafts were extremely heavy and bulky to maneuver, but were also exceptionally tough and forgiving on the big volume, rocky rivers of the west.

The military assault rafts of World War II were still used occasionally on rivers. They were made in seven-man and ten-man sizes and were constructed of neoprene-canvas. A surplus raft design featured a pointed, slightly raised bow and a flat, truncated stern. The main tubes were small, only about 15 inches, but their protruding spray shields worked fairly well in keeping water out of the raft.

The surplus rafts of World War II sufficed as river boats for some time, but commercial outfitters getting into the rafting business decided that they needed a raft with a slightly larger payload than that of the ten-man. The result was a model known as the "Green River", designed by Grand Canyon outfitter Ron Smith and Rubber Fabricators Company manager Del Mosser. The Green River had several advantages over the ten-man surplus raft. Instead of heavy canvas, it was built with lighter weight nylon, and its overall design was a blunt-nosed symmetrical shape, with a slight uplift at each end. It also had larger tubes and more inflation compartments than the surplus model.

Refinements in river rafts continued. Hypalon was developed as a more durable coating than neoprene. Designs also improved, with bow and stern lift becoming more pronounced. Chafing strips were added to the top and bottom of the raft to protect against rubbing of the rowing frame and abrasion from rocks and river beds. Developments in raft materials and design continued further. Polyester and Kevlar (TM) are the most recently used fabrics, and the newest coatings include polyvinyl chloride (PVC) and polyurethane. These improvements in materials have led to more sophisticated designs, including boat rigidity and tighter floors.

One of the more novel raft designs to hit the river has been patterned after the catamaran. Adapted to river running, this design consists of inflatable tubes used either in pairs with an open center or lashed together to form a mattress-like platform. The tubes of the catamaran raft may be of two different types, either "sausage" tubes or the upward-pointing "J"-tubes. For years, several commercial outfitters on the Colorado River, and especially in the Grand Canyon, have used the "J"-tube model, with lengths ranging from 21 to 33 feet, while the smaller sausage-tube is used commercially on both the California and Oregon Rivers.

Two smaller catamaran rafts, sometimes known in the West as the Cataraft and the Huck Finn, are excellent for the private river runner. The spider-like Cataraft uses two tubes connected with a frame, but with the center open. The Huck Finn, reminiscent of Mark Twain's legendary character, is assembled by lashing four tubes closely together with a metal rowing frame and nylon webbing straps. Any size tubes may be used, but the most common are those ranging from 13–15 feet.

Both the Huck Finn and the Cataraft offer several advantages over conventional rafts. The foremost advantage, of course, is the self-bailing feature, which prevents the raft from becoming filled with water and possibly "wrapping" around a boulder. Because the rafts eliminate the need for bailing and are impossible to swamp, they offer greater safety. Unlike other rafts, they cannot be filled with great quantities of water and rendered sluggish. The Cataraft is a sport raft, as it gives a fast, thrilling ride. This raft is especially ideal for rocky rivers, where the chance of hitting rocks is reduced 50% because the Cataraft straddles them. When penned against a rock or Canyon wall, the upstream tube of traditional raft may be forced under water. The Cataraft, however, allows the water to pour through its open center without causing an upset. To free the Cataraft when stuck broadside on a rock, the boater can work in the center space, which is much safer than going over the side as required with other rafts.

With the great amount of flotation it provides the Huck Finn is capable of heavy loads. It also protects passengers from rock bruises which can occur in conventional rafts if someone is thrown on the floor and a rock passes underneath.

In the past, rafts have been made of coated fabrics. The base fiber provides the material's strength and resistance to tearing, while the coating provides airtightness and abrasion resistance. Cotton canvas was used as the base fiber in World War II assault rafts, but it was soon replaced by nylon. Nylon is still the most popular fabric, but polyester and Kevlar (TM) are increasingly used for their strength and stiffness. As for coatings, neoprene was the standard for many years, but has recently been displaced by the more durable, and also more expensive, Hypalon, a product of DuPont. Newer coatings have also appeared, including polyvinyl chloride (PVC) and polyurethane. The typical combinations of base fibers and coatings include: nylon/neoprene, nylon/Hypalon, polyester/PVC, and Kevlar (TM)/polyurethane. The technology of material used in rafts has been improving throughout the years. As with all materials, the various materials used on rafts are subject to various quality and cost considerations.

For commercial river runners, it is important that the consumer be afforded an enjoyable, yet safe, ride. Commercial river runners have found that the ride is most enjoyable when a great deal of spray occurs and when the ride is very fast. Times of sluggish movement through the water offer an uninresting ride for the passenger. Additionally, the efforts required to oar the boat through sluggish water are a tremendous burden on the oarsman. As such, it is desirable to have the raft perform quickly in fast water and be suitable for far more streamlined movement in slow water.

In commercial river running operations, the access point to the river can often be in a remote location. Additionally, the cost of transport of the raft to the river is an important consideration. In those circumstances where the raft is bulky and cumbersome, a great deal of labor is required to transport the raft to the river. As such, it is desirable to have a river raft which may be contained within a small volume and be suitable for easy transportation. It is also important to have the ability to assemble to raft at the water's edge.

Given the high levels of insurance for those operating river running services, it is also very desirable to offer a safe ride to the passenger. It is desirable to build a raft that is very safe and difficult to capsize. To succeed in the river running business, the river runner, in the past, has had to balance the considerations of safety against those of providing thrilling rides.

A river raft having the characteristics of fast movement, stability, and strength is disclosed in U.S. patent application Ser. No. 322,292, filed on March 13, 1989, and entitled "River Raft". The subject of this patent application was the invention of the present inventor. In this application, a river raft is described that utilizes a first solid pontoon having a hollow interior and a second solid pontoon having a hollow interior. These pontoons are made by utilizing roto-molded plastic material. A plurality of crossmembers extend through these solid pontoons so as to maintain the pontoons in spaced relationship. A central area suitable for accommodating coolers and ice chests, for providing the foothold for the oarsman is also included in the design of U.S. patent application Ser. No. 322,292. The design of the river raft of this application is a superior improvement of previous river rafts. However, for particular purposes, it can be difficult to transport such a raft having solid pontoons and a rigid frame.

It is an object of the present invention to provide a river raft that is very stable in water.

It is another object of the present invention to provide a river raft that moves quickly in water and is easily maneuverable.

It is still another object of the present invention to provide a river raft that is relatively inexpensive.

It is still a further object of the present invention to provide a river raft that can be disassembled, collapsed, and stored in a small volume.

It is still another object of the present invention to provide a river raft that is adaptable to a wide range of uses, and adaptable to a varying number of passengers.

These and other objects and advantages of the present invention will become apparent from a reading of the attached specification and appended claims.

SUMMARY OF THE INVENTION

The present invention is a raft that comprises a first pontoon, a second pontoon, a framework detachably connected to the first and second pontoons and positioned on the top surface of the pontoons, and a floor system connected to the framework. The floor defines a surface extending on the framework above the first and second pontoons. Each of the first and second pontoons is arranged in parallel relationship to each other. The pontoons are, preferably, inflatable. However, solid pontoons could also be used under appropriate circumstances.

The framework of the raft of the present invention comprises a first longitudinal member extending along the top surface of the first pontoon, a second longitudinal member extending along the top surface of the second pontoon, a first crossmember connected to one end of the first and second longitudinal members, and a second crossmember connected to the other end of the first and second longitudinal members. The framework further comprises a first medial longitudinal member extending along the top surface of the first pontoon and a second medial longitudinal member extending along the top surface of the second pontoon. A channel extends through the area between the first and second pontoons. These first and second medial longitudinal members are arranged adjacent to this channel. The framework of the present invention further comprises a first medial crossmember connected to the first longitudinal member and to the second longitudinal member and a second crossmember connected to the first longitudinal member and to the second longitudinal member. These first and second medial crossmembers define a central area within the framework of the present invention. The first longitudinal member, the second longitudinal member, the first medial longitudinal member, and the second medial longitudinal member comprise a plurality of connected sections of tubing. Specifically, each of these comprises a first section of square tubing, a second section of square tubing having a cross-section matching the cross-section of the first section of square tubing, and a sleeve that fits around the exterior of the first and second sections. The sleeve has an aperture that matches corresponding apertures in the first and second sections. A clavis pin extends through these apertures so as to maintain the first and second sections in fixed position relative to each other and within the sleeve. The longitudinal members are all strapped to the pontoons so as to maintain these longitudinal members in position adjacent to the pontoons. As such, the framework is releasably fastened to the exterior of the first and second pontoons.

The floor system of the present invention initially comprises a mesh material that is attached to the framework and extends across a portion of the area of the framework. Additionally, the floor system includes a saddle, a flat surface connected to the bottom side of the saddle, and a crossbar that extends perpendicular to the saddle and is suitable for detachable connection to the framework. The saddle is a generally hollow formed plastic saddle. A cap is threadedly connected to the saddle for enabling access to the hollow interior of the saddle. This cap is in liquid-tight engagement with the saddle. The flat surface that is fastened to the saddle is made of a rigid foam material. The crossbar of the saddle comprises a first round tubing that is fastened to the bottom of the saddle and extends outwardly beyond the flat surface of the saddle, and a second round tubing that is fastened to another portion of the bottom of the saddle and extends parallel to the first round tubing. Each of the first and second round tubings has ends of flat L-shaped configuration for fitting over the exterior of the square tubing of the framework.

The floor system of the raft of the present invention further includes a decking of solid material fitted to the framework in the area generally between the first and second pontoons. This decking has suitable attachment members on the underside of the decking for fastening the decking to the framework. Specifically, the decking includes a foothold member that extends outwardly from the top surface of the decking. This foothold member is an inverted U-shaped tubular member attached to a flat steel plate. The flat steel plate is bolted to the decking.

The raft of the present invention further comprises a first oarlock assembly fastened to the first longitudinal member and extending upwardly therefrom. This first oarlock assembly has support members that extend outwardly from the top of the oarlook assembly and engage the first and second medial crossmembers. A second oarlock assembly is fastened to the second longitudinal member and extends upwardly therefrom. The second oarlock assembly also has support members that extend outwardly from the top of the oarlock assembly and engage the first and second medial crossmembers.

Within the floor configuration, there is a cooler receptacle area that is defined by the medial crossmembers in the framework and located specifically in the channel between the first and second pontoons. The framework has upwardly tilted forward and rearward ends. These ends of the framework are inward of the ends of the first and second pontoons.

DETAILED DESCRIPTION OF THE INVENTION

Figure 1:
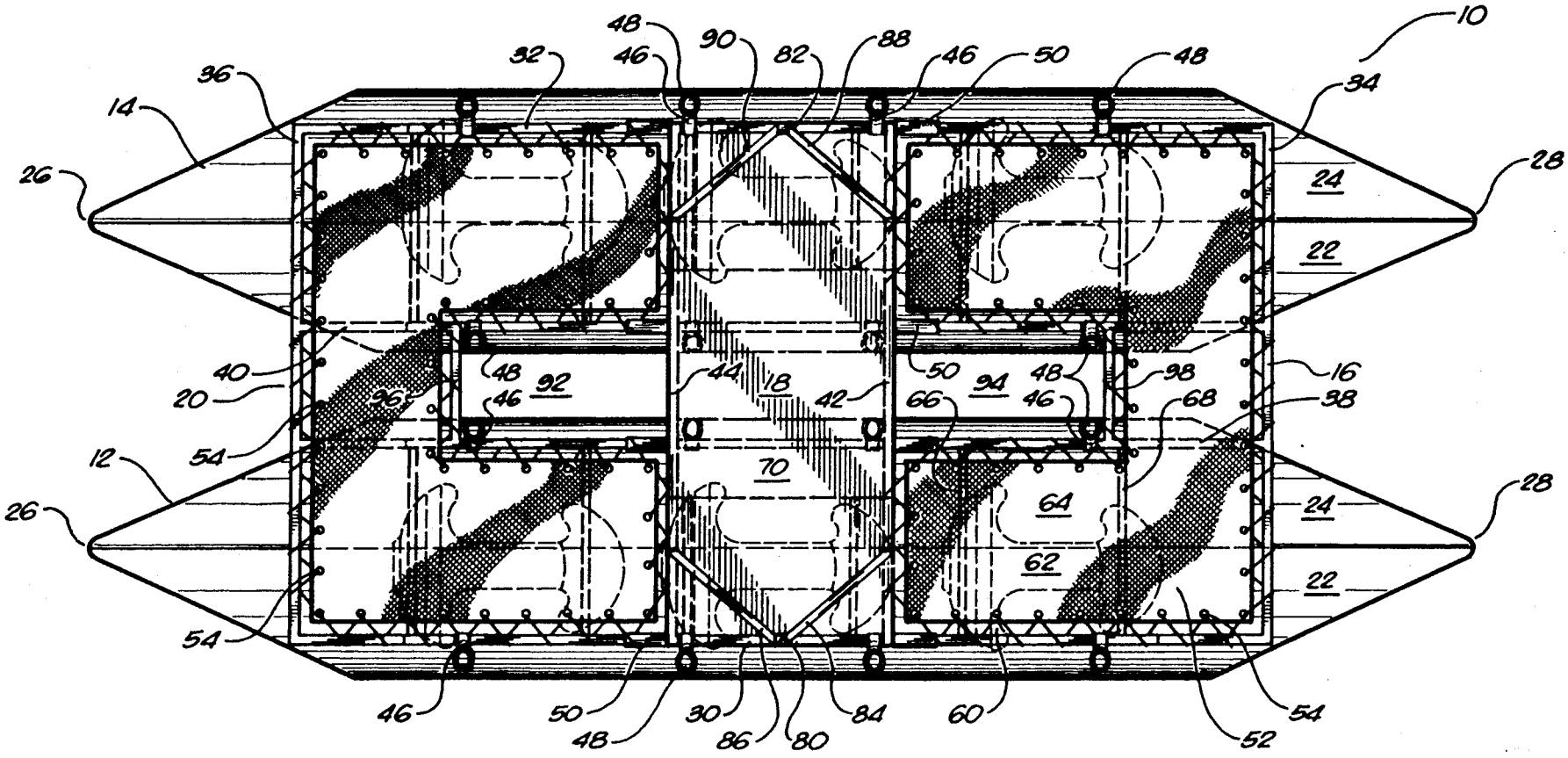
FIG. 1 is a top view showing the configuration of the river raft of the present invention and showing, in dotted line fashion, the locations of the saddles and other components of the floor system.

Referring to FIG. 1, there is shown the raft 10 in accordance with the preferred embodiment of the present invention. Raft 10, as illustrated in FIG. 1, includes a first pontoon 12, a second pontoon 14, a framework 16 that is detachably connected to the first pontoon 12 and the second pontoon 14, and a floor system 18 that is connected to the framework 16 and positioned above the first pontoon 12 and the second pontoon 14. The first pontoon 12 and the second pontoon 14 are arranged generally parallel to each other and so as to have a channel area 20 extending therebetween.

Figure 2:
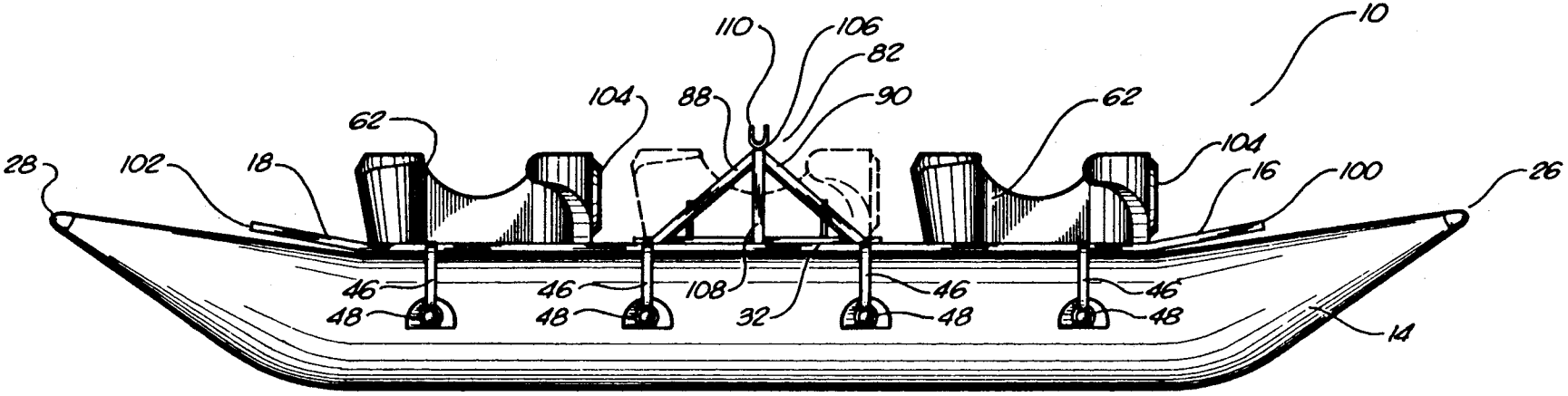
FIG. 2 is a side view of the river raft of the present invention.

First pontoon 12 and second pontoon 14 are, preferably, inflatable tubes. Specifically, each of these pontoon comprises a first inflatable compartment 22 and a second inflatable compartment 24. The first inflatable compartment 22 is rigidly affixed to a surface of the second inflatable compartment 24. Both the forward end 26 and the rearward end 28 are generally pointed and upwardly tilted (as illustrated in FIG. 2). By having the ends 26 and 28 pointed, the pontoons 12 and 14 of the present invention allow the raft to pass through water in a clean hydrodynamic fashion. As such, the raft of the present invention can achieve easy maneuverability and high speeds relative to the movement of the water. The configuration of the pontoons 12 and 14 of the present invention also allows the oarsman of the raft 10 of the present invention to move through still water relatively quickly.

Although inflatable tubes are described in conjunction with the preferred embodiment, it should be noted that under particular circumstances, solid or rigid pontoons may be utilized. Rigid pontoons of various plastics can be used with the framework 16. A more detailed description of such pontoons is provided in conjunction with U.S. application Ser. No. 322,292. The inflatability of the pontoons 12 and 14 should not be construed as a limitation on the present invention.

The framework 16 of the present invention has a first longitudinal member 30 that extends along the top surface of the first pontoon 12. A second longitudinal member 32 extends along the top surface of the second pontoon 14. A first crossmember 34 is connected to one end of the first longitudinal member 3 and one end of the second longitudinal member 32. This first crossmember 16 extends between each of the first pontoon 12 and the second pontoon 14. Similarly, a second crossmember 36 is connected to the other ends of the first longitudinal member 30 and the second longitudinal member S2 adjacent the other end of the pontoons. The longitudinal members 30 and 32 and the crossmembers 34 and 36 define a rectangular configuration about the top surface of the pontoons 12 and 14. This framework 16 is detachably connected to the exterior of the pontoons 12 and 14. The framework 16 also includes a first medial longitudinal member 38 that extends along the top surface of the first pontoon 12 and is adjacent the channel 20 of raft 10. A second medial longitudinal member 40 is positioned adjacent the channel 20 on the second pontoon 14. The second medial longitudinal member 40 also extends along the top surface of pontoon 14. The framework 16 further includes a first medial crossmember 42 that is connected to the first longitudinal member 30 and to the second longitudinal member 32 and extends across the pontoons 12 and 14. A second medial crossmember 44 is also connected to the first longitudinal member 30 and the second longitudinal member 32. The framework 16 is detachably connected to the pontoons 12 and 14 by a plurality of straps 46 which are fastened to D-rings 48. The D-rings 48 are glued to the exterior of the pontoons 12 and 14. Specifically, the straps 46 are nylon cam straps.

Each of the longitudinal members 30, 32, 38 and 40 comprise a plurality of connected sections. Sleeves 50 are configured so as to receive the ends of each of the sections of longitudinal tubing. A more detailed description of this manner of connection is described in more detail in FIG. 3.

The floor system 18 of the present invention comprises a plurality of components. Specifically, a mesh material 52 is laced to the framework 16 and extends across a portion of the area of the framework 16. A nylon lacing may be utilized so as to pass through grommets 54 and to the framework 16. The mesh material may be utilized to retain equipment, supplies, or other materials on the surface of the raft 10. In addition, the mesh material will allow spray or other accumulations of liquid to pass through the mesh material without accumulating on the surface of raft 10.

In addition to the mesh material, the floor system 18 of the present invention further comprises a saddle system 60. Specifically, the saddle system 60 includes saddle 62, flat surface 64, and a pair of crossbars 66 and 68. A more detailed description of the saddle system is described in connection with FIGS. 6 and 7. As can be seen in FIG. 1, a total of six saddles (illustrated in broken line fashion) can be received on the area of the framework 16. It should be noted that the selection of saddle systems can be incorporated onto framework 16 as desired. It may be desirable to include fewer saddles if there are fewer passengers on the raft 16. The ability to add and remove seats is a significant advantage of the present invention. The saddles as illustrated in FIG. 1 are a type of saddle known as a "Perception Saddle". This saddle is manufactured by Perception Kayak of Easley, S.C. It should be noted that it is only the saddle 62 that is manufactured by Perception Kayak and not the flat surface 64, nor the crossbars 66 and 68. With regard to the crossbars 66 and 68, it can be seen that the crossbars attach at one end to the longitudinal members SO or S2. At the other end, the crossbars 66 and 68 connect to the medial crossmembers 38 and 40. The manner in which the crossbars 66 and 68 are received by the longitudinal members is illustrated in greater detail in FIG. 10.

Figure 8:
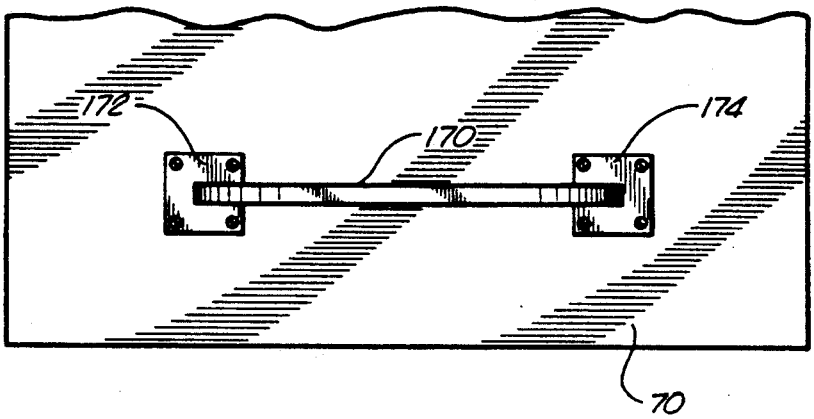
FIG. 8 is a top view of the foothold member and decking as used in the present invention.
Figure 9:
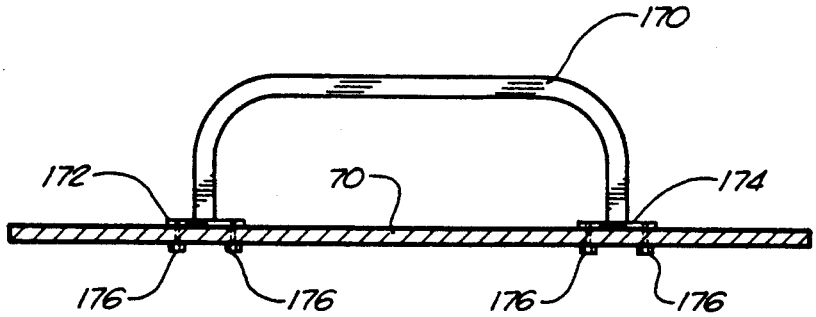
FIG. 9 is a side view of the foothold member and decking of the present invention.

The floor system of the present invention further includes a decking 70 that is fitted to the framework 16 in the area generally between the first pontoon 12 and the second pontoon 14. The decking 70 may be made of any solid material. It has been found that plywood would be appropriate for decking 70. The type of material, however, should not be construed as a limitation on the present invention. The decking will include the foothold for the oarsman of the raft 10. FIGS. 8 and 9 illustrate, in greater detail, the configuration of the decking 70. The decking 70 is suitably positioned in the interior of the framework 16.

The raft 10 further comprises a first oarlock assembly 80 and a second oarlock assembly 82. The first oarlock assembly 80 is fastened to the first longitudinal member SO and extends upwardly therefrom. This first oarlock assembly has support members 84 and 86 that extend outwardly from the top of the first oarlock assembly 80 and engage the first medial crossmember 42 and the second medial crossmember 44. Similarly, the second oarlock assembly 82 is fastened to the second longitudinal member S2 and extends upwardly therefrom. The second oarlock assembly 82 includes support members 88 and 90 that extend outwardly from the top of the oarlock assembly 82 and engage the first medial crossmember 42 and the second medial crossmember 44. These oarlock assemblies may be detachably connected to the framework 16 so as to be added or removed as required.

The framework 16 and the floor system 18 offer significant advantages. First of all, the plurality of sections used to assemble the framework 16 allow for easy transportability. If it is necessary to disassemble the framework 16, then this can be easily accomplished by removing clavis pins from the sleeves 50. Additionally, the floor system is arranged with a variety of components. When broken down, the components occupy a very small storage volume. Additionally, the floor system can be adapted to the particular purposes of the rafting environment. If only two rafters are travelling on a river, then the floor system 18 can receive only two saddles. Additionally, the mesh utilized as the floor of raft 10 can be transported in a very small volume prior to assembly.

Referring to FIG. 1, there is an area 92 and 94 which is utilized for receiving "GOTT 80" portable coolers. Area 92 is bounded by second medial crossmember 44, first medial longitudinal member 38 and second medial longitudinal member 40, and a crossbar 96. Since the coolers have a tapered configuration, they will easily fit into the area 92. Since this area 92 is adjacent the channel 20, the bottom of the cooler fitted within area 92 will be exposed to the cooling effect of water passing through channel 20.

Area 94 is defined by first medial crossmember 42, first medial longitudinal member S8, second medial longitudinal member 40, and crossbar 98. The configuration of area 94 is similar to that of 92 so as to receive the cooler. The insertion of a cooler into this area allows for the transport of food and drink supplies on the raft.

FIG. 2 is a side view of raft 10. Specifically, it can be seen that raft 10 includes the pontoon 14, the framework 16, and the floor system 18. In FIG. 2, pontoon 14 includes a forward upwardly tilted end 26 and a rearward upwardly tilted pointed end 28. In order to accommodate the tilting of ends 26 and 28, framework 16 includes an upwardly tilted forward end 100 and a rearward upwardly tilted end 102. As flexing of ends 26 and 28 occurs the ends 100 and 102 of framework 16 will accommodate this flexing without exerting pressure on the tubes of pontoon 14 Although upwardly tilting ends 100 and 102 are described and are preferable, many different types of pontoons could be utilized. Some pontoons have such ends and other types of pontoons have different end configurations. As such, the shape of the pontoon ends should not be construed as a limitation on the present invention.

It can be seen in FIG. 2 that framework 16 is connected by the nylon cam straps 46 to D-rings 48. As such, the framework 16 can be detachably connected to the pontoon 14. As can be seen, the saddle 62 extends from the top surface of framework 16 upwardly. Saddle 62 includes a cap 104 that is threaded connected to the saddle 62. Saddle 62 is hollow. The cap 104 allows access to this hollow interior of saddle 62. The cap is suitable for liquid-tight engagement with saddle 62. The hollow interior of saddle 62 acts as a suitable storage volume for extra clothing or supplies as required by the rafter. In FIG. 2, it can be seen that the oarlock assembly 82 includes support members 88 and 90 that extend downwardly from the top 106 of the oarlock assembly 62. The support members 88 and 90 extend outwardly from top portion 106. A central member 108 is attached to the second longitudinal member 32. Member 108 is a vertical member that extends upwardly and has the U-shaped member 110 attached at the end opposite longitudinal member 32. The U-shaped member 110 receives an oar.

Figure 3:
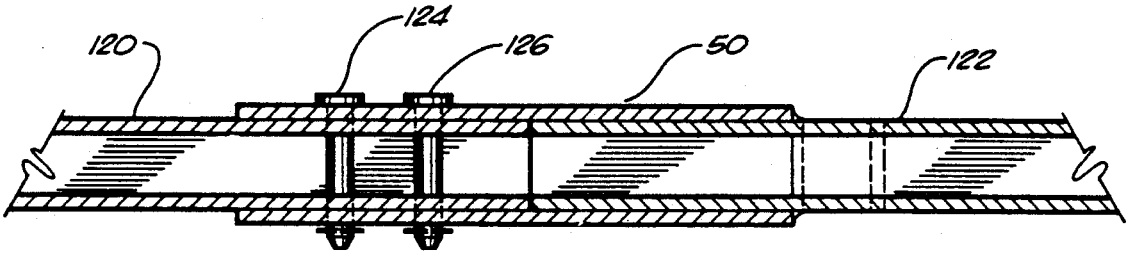
FIG. 3 is a cross-sectional view showing the arrangement of tubing as received within the sleeves.

FIG. 3 is a cross-sectional view illustrating the configuration of the sleeve 50 as utilized to connect adjacent sections of the longitudinal members. Specifically, it can be seen in FIG. 3 that members 120 and 122 are separate sections of a longitudinal member. After experimentation, it was found that the ideal and preferred structure of the longitudinal members was made up of one inch square tubing. As such, sleeve 50 will have an interior cross-section generally matching the exterior cross-section of the sections 120 and 122. Clavis pins 124 and 126 extend through apertures in the sleeve 50 and the sections 120 and 122 so as to fix the sections 120 and 122 within the sleeve 50. As such, the sections 120 and 122 are stabilized within sleeve 50 and are retained in permanent engagement. When disassembly is required, the clavis pins 124 and 126 may be removed from the apertures. Sections 120 and 122 will then slide from within sleeve 50.

Figure 4:
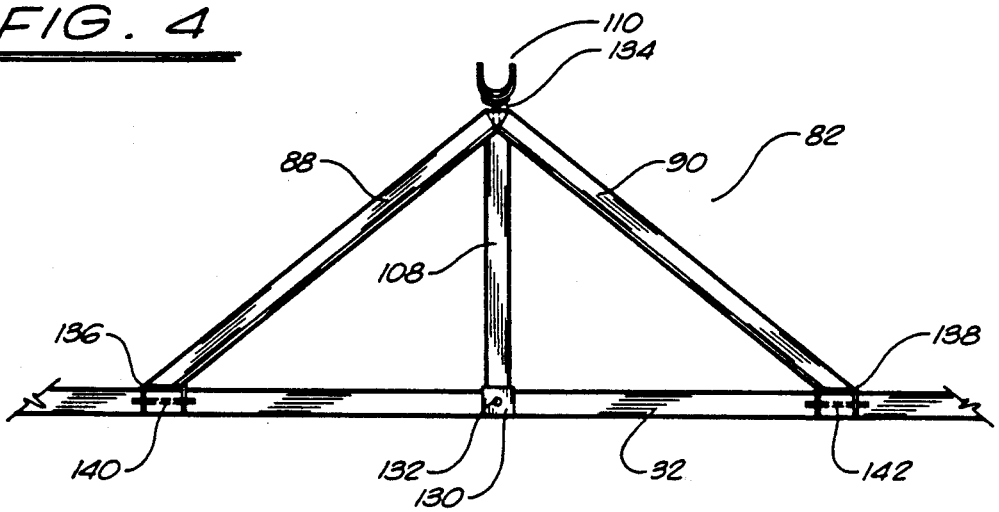
FIG. 4 is a isolated view showing the configuration of the oarlock assembly of the present invention.

FIG. 4 illustrates second oarlock assembly 82. Specifically, in FIG. 4, it can be seen that the vertical member 108 is fastened to the second longitudinal member 32 by a bracket 130. Bracket 130 includes an aperture that is suitable for receiving clavis pin 132. This aperture 132 will match a corresponding aperture within the longitudinal member 132. The U-shaped member 110 extends outwardly from the top of vertical member 108. A suitable rotating mechanism 134 is incorporated into the connection between U-shaped member 110 and vertical member 108 so as to allow the oarsman to adjust and rotate the oar as required. Support members 88 and 90 extend downwardly from the top of vertical member 108. Support members 88 and 90 are connected by bracketing members 136 and 138 to the medial crossmembers. Suitable clavis pins 140 and 142 are included so as to allow the joining of the support members 88 and 90 to the medial crossmembers.

Figure 5:
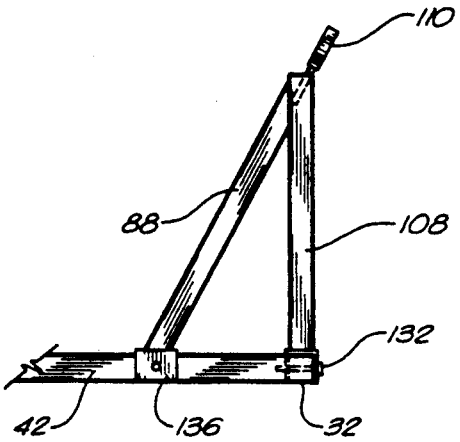
FIG. 5 is a side view showing the arrangement of the oarlock assembly of the present invention.

In FIG. 5, it can be seen that U-shaped member 110 is angled at an angle generally matching the angle of support member 88. Vertical member 108 extends downwardly and is joined by clavis pins 132 with the longitudinal member 32. Similarly, FIG. 5 illustrates the joining of bracket 136 of the support member 88 to the medial crossmember 42.

Figure 6:
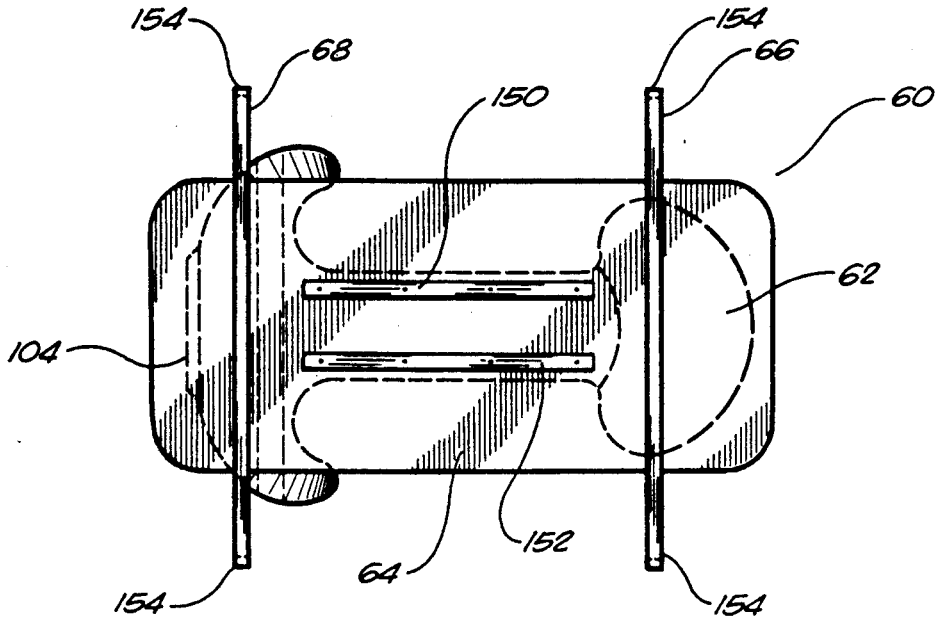
FIG. 6 is a bottom view of the saddle of the present invention.

FIG. 6 illustrates the saddle portion 60 of the floor system 18 of the present invention. Specifically, the saddle system 60 comprises a saddle 62, a flat surface 64, and crossbars 66 and 68. The flat surface 64 is a one-half inch ETHAFORM (TM) pad. Since the flat surface 64 is a rather rigid foam material, it is suitable for receiving the knees of the passenger on saddle 62. Flat surface 64 is attached to saddle 62 by aluminum straps 150 and 152. Crossbars 66 and 68 are attached to the flat surface 64 and to the saddle 62. Crossbars 66 and 68 are steel tubing having flattened end portions 154.

Figure 7:
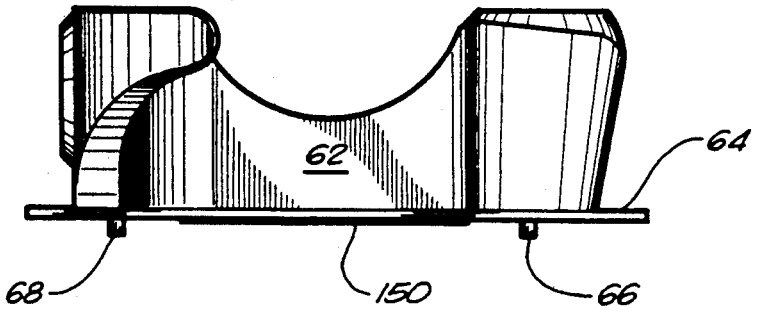
FIG. 7 is a side view of the saddle as used on the raft of the present invention.

FIG. 7 illustrates a side view of the saddle system of FIG. 6. Specifically, saddle 62 is attached to flat surface 64 by aluminum straps 150. The crossbars 66 and 68 extend perpendicular to the longitudinal axis of saddle 62. The crossbars 66 and 68 serve to connect the saddle 62 to the longitudinal members and the medial longitudinal members of the framework of the raft of the present invention.

Figure 10:
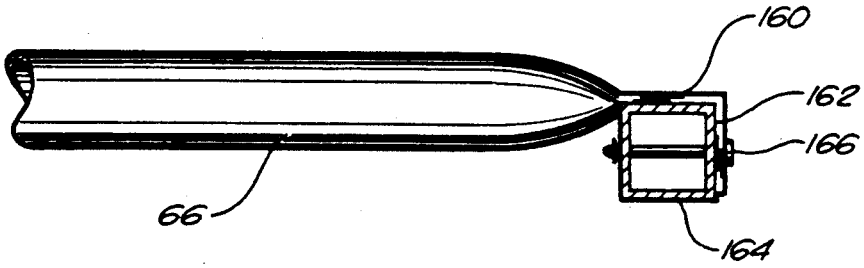
FIG. 10 is a detailed view showing the arrangement of components to longitudinal members.

Referring to FIG. 10, the manner in which the crossbars 66 and 68 attach to the longitudinal members is specifically illustrated. In FIG. 10, crossbar 66 is a round tubing. The round tubing 66 includes a flattened portion 160 and another flattened portion 162. The shape of flattened sections 160 and 162 is of L-shaped configuration. This L-shaped configuration of flattened sections 160 and 162 matches the exterior shape of longitudinal member 164. It can be seen in FIG. 10 that the longitudinal member 164 is a square-shaped tubing. Flattened section 162 includes an aperture that matches a corresponding aperture extending through longitudinal member 164. As such, clavis pins 166 are used to retain the flattened L-shaped sections 160 and 162 onto the longitudinal member 164.

FIG. 8 illustrates decking 70. Decking 70 includes a foothold member 170. Foothold member 170 extends outwardly from the top surface of the decking 70. The foothold member is an inverted U-shaped tubular member that is attached to flat steel plate pieces 172 and 174. Steel plate pieces 172 and 174 are bolted to the decking 70.

FIG. 9 illustrates the inverted U-shaped configuration of foothold member 170. The steel plate pieces 172 and 174 are illustrated as connected to the end of the foothold member 170. The bolts 176 extend through the decking 70 so as to rigidly affix the foothold member 170 thereto.

In raft usage, the decking serves to assist the oarsman of the raft. The decking offers a solid surface onto which the oarsman can place his feet. The foothold member 170 is suitable for offering a resistive force to the movement of the oarsman during the rowing action of the raft 10. As such, the oarsman can efficiently traverse water and conduct proper rowing action. The decking 70 can be attached to the medial longitudinal members S8 and 40 utilizing crossbars of a type indicated in FIG. 10.

The raft of the present invention offers a number of advantages not found in previous rafts. First, and most importantly, each of the components of the present invention is detachable and compressible. For example, the pontoons 12 and 14 of the raft are deflatable for easy storage. The framework 16 of the present invention can be detached into a number of separate sections for easy storage. Each of the components of the floor system may be removed from the framework so as to be separately storable in a small area.

Another advantage of the present invention is that it can be utilized for a varying number of passengers and tasks. The number of seats on the raft can be varied to accommodate the number of passengers. The oarlocks can be attached or detached depending on the requirements of the rafting trip.

The present invention offers further significant advantages over presently existing rafts. Initially, because of the catamaran design of the river raft 10 of the present invention, the raft will move through the water at a faster rate. In addition, greater stability is achieved because of this catamaran configuration. The hydrodynamic shape of the pontoons allows the raft to be moved through slow water at a faster rate by the oarsman. The use of the elevated central portion above the channel 20 eliminates the problems of injuries to the passengers caused by abutting rocks or other objects in the water.

The present invention offers a maximum of storage volume available to the commercial river runner. The interior of the saddles provides storage volume, and the interior of the ice chests provides storage volume. Additionally storage capacity is available above the mesh surface across the framework. The stylized saddles of the present invention provide the passenger with an enjoyable ride with maximum safety.

The foregoing disclosure and description of the invention is illustrative and explanatory thereof, and various changes in the size, shape, and materials, as well as in the details of the illustrated construction, may be made within the scope of the appended claims without departing from the true spirit of the invention. This invention should only be limited by the appended claims and their legal equivalents.

I claim:

1. A raft comprising:

a first pontoon;
a second pontoon;
a framework detachably connected to said first and second pontoons, said framework positioned on the top surface of said first and second pontoons, said first and second pontoons arranged parallel to each other, said framework comprised of a plurality of separable members; and
a floor means connected to said framework, said floor means defining a surface extending on said framework above said first and second pontoons, said floor means comprising:
a saddle;
a flat surface connected to the bottom of said saddle; and
a crossbar extending perpendicular to said saddle, said crossbar being detachably connected to said framework, said crossbar comprising:
a first round tubing fastened to the bottom of said saddle and extending outwardly beyond said flat surface; and
a second round tubing fastened to another portion of the bottom of said saddle, said second round tubing being parallel to said first round tubing, each of said first and second round tubings having ends of flat L-shaped configuration, said L-shaped configuration fitting over the exterior of said framework.

2. The raft of claim 1, said framework comprising:
a first longitudinal member extending along the top surface of said first pontoon;
a second longitudinal member extending along the top surface of said second pontoon;
a first crossmember connected to one end of said first and second longitudinal members; and
a second crossmember connected to the other end of said first and second longitudinal members.

3. The raft of claim 2, said first and second pontoons separated by a channel, said framework further comprising:
a first medial longitudinal member extending along the top surface of said first pontoon, said first medial longitudinal member being adjacent said channel; and
a second medial longitudinal member extending along the top surface of said second pontoon, said second medial longitudinal member being adjacent said channel.

4. The raft of claim 2, said framework further comprising:
a first medial crossmember connected to said first longitudinal member and to said second longitudinal member; and
a second medial crossmember connected to said first longitudinal member and to said second longitudinal member, the distance between said first medial crossmember and said second medial crossmember defining a central area within said framework.

5. The raft of claim 3, each of said first longitudinal member said second longitudinal member said first medial longitudinal member, and said second medial longitudinal member comprising a plurality of connected sections.

6. The raft of claim 3, each of said first longitudinal member, said second longitudinal member, said first medial longitudinal member, and said second medial longitudinal member comprising:
a first section of square tubing;
a second section of square tubing having a crosssection matching the cross-section of said first section;
a sleeve fitting around said first section and said second section, said sleeve having an aperture matching a corresponding aperture in said first and second sections; and
a clavis pin extending through said aperture in said first and second sections and said sleeve so as to maintain said first and second sections in fixed position relative to each other.

7. The raft of claim 3, said first longitudinal member and said first medial longitudinal member being strapped to said first pontoon, said second longitudinal member and said second medial longitudinal member being strapped to said second pontoon.

8. The raft of claim 1, said framework comprising a plurality of square tube members detachably interconnected and extending across the top of said first and second pontoons, said framework being releasably fastened to the exterior of said first and second pontoons.

9. The raft of claim 8, said framework comprising:
a sleeve member positioned around said square tube members at the interconnections of said square tube members, said sleeve member having a plurality of apertures extending therethrough; and
a clavis pin extending through said sleeve member so as to engage the square tube members within said sleeve, said clavis pin for fixing the position of said square tube members relative to said sleeve.

10. The raft of claim 1, said floor means comprising:
a mesh material attached to said framework and extending across a portion of the area within said framework.

11. The raft of claim 1, said floor means further comprising:
a decking of solid material fitted to said framework in the area generally between said first and second pontoons, said decking having attachment means on the underside of said decking for fastening said decking to said framework.

12. The raft of claim 11, said floor means further comprising:
a foothold member extending outwardly from the top surface of said decking, said foothold member comprising an inverted U-shaped tubular member attached to a flat steel plate, said flat steel plate being bolted to said decking.

13. The raft of claim 4, further comprising:
a first oarlock assembly fastened to said first longitudinal member and extending upwardly therefrom, said first oarlock assembly having support members extending outwardly from the top of said oarlock assembly and engaging said first and second medial crossmembers, and a second oarlock assembly fastened to said second longitudinal member and extending upwardly there from, said second oarlock assembly having support members extending outwardly from the top of said second oarlock assembly and engaging said first and second medial crossmembers.

14. The raft of claim 1, said framework comprising:
a cooler receptacle area defined by crossmembers in said framework in the channel between said first pontoon and said second pontoon.

15. The raft of claim 1, each of said first and second pontoons being inflatable.

16. The raft of claim 15, each of said first and second pontoons having a forward upwardly tilted pointed end and a rearward upwardly tilted pointed end.

17. The raft of claim 16, said framework having upwardly tilted forward and rearward ends, said ends of said framework being inward of the ends of said first and second pontoons.

18. A raft comprising:

a first pontoon;

a second pontoon;

a framework detachably connected to said first and second pontoons, said framework positioned on the top surface of said first and second pontoons, said first and second pontoons arranged parallel to each other, said framework comprised of a plurality of separable members; and a floor means connected to said framework, said floor means defining a surface extending on said framework above said first and second pontoons, said floor means comprising:

a saddle;

a flat surface connected to the bottom of said saddle; and a crossbar extending perpendicular to said saddle, said crossbar being detachably connected to said framework, said saddle being generally hollow, said saddle having a cap threadedly connected to said saddle for enabling access to the hollow interior of said saddle, said cap in liquid-tight engagement with said saddle, said flat surface being a rigid foam material.

* * * * *